US011804344B2

(12) United States Patent
Zhou

(10) Patent No.: US 11,804,344 B2
(45) Date of Patent: Oct. 31, 2023

(54) DRIVE STRUCTURE FOR HIGH-VOLTAGE DIRECT-CURRENT RELAY

(71) Applicant: SENSATA CHUROD TECHNOLOGY (WUHU) CO., LTD, Wuhu (CN)

(72) Inventor: Kangping Zhou, Dongguan (CN)

( * ) Notice: Subject to any disclaimer, the term of this patent is extended or adjusted under 35 U.S.C. 154(b) by 195 days.

(21) Appl. No.: 17/427,065

(22) PCT Filed: Apr. 2, 2020

(86) PCT No.: PCT/CN2020/082877
§ 371 (c)(1),
(2) Date: Jul. 29, 2021

(87) PCT Pub. No.: WO2021/004104
PCT Pub. Date: Jan. 14, 2021

(65) Prior Publication Data

US 2022/0122789 A1 Apr. 21, 2022

(30) Foreign Application Priority Data

Jul. 9, 2019 (CN) ..... 201910612537.6

(51) Int. Cl.
*H01H 33/08* (2006.01)
*H01H 50/02* (2006.01)
(Continued)

(52) U.S. Cl.
CPC ..... *H01H 3/08* (2013.01); *H01H 50/02* (2013.01); *H01H 50/641* (2013.01)

(58) Field of Classification Search
CPC ..... H01H 33/08; H01H 50/02; H01H 50/641; H01H 3/001; H01H 1/2016; H01H 1/2083;
(Continued)

(56) References Cited

U.S. PATENT DOCUMENTS 4,513,270 A * 4/1985 Belbel ..... H01H 77/101 335/16
7,423,504 B2 * 9/2008 Kon ..... H01H 1/18 335/133
(Continued)

FOREIGN PATENT DOCUMENTS

CN 105719865 A 6/2016
CN 106504952 A 3/2017
(Continued)

*Primary Examiner* — Bernard Rojas
(74) *Attorney, Agent, or Firm* — Tsz Lung Yeung

(57) ABSTRACT

Provided is a drive structure for a high-voltage direct-current relay, the drive structure comprising: a retaining frame, a stopper piece, a movable spring piece, and an elastic member. The retaining frame comprises two retaining side arms, a support plate, and a drive rod. The two retaining side arms are disposed at two sides of the support plate, and the drive rod is connected to a bottom portion of the support plate. The stopper piece has one end connected to a terminal end of one of the retaining side arms, and the other end connected to a terminal end of the other retaining side arm. The elastic member has one end pressing against the support plate and the other end pressing against the movable spring piece, the movable spring piece presses against the stopper piece, and the stopper piece is provided with an arc isolation portion. The drive structure for a high-voltage direct-current relay has an bottom-up assembly manner, in which the elastic member, the movable spring piece, and the stopper piece are stacked sequentially, and the stopper piece is connected to and retained by the two retaining side arms, thereby realizing a simple and fast assembly process, and increasing assembly efficiency of high-voltage direct-current relays. In addition, the arc isolation portion has an effect of isolating arcs, thereby improving a service life of high-voltage direct-current relays despite reverse arcs.

9 Claims, 6 Drawing Sheets

(51) Int. Cl.
*H01H 50/64* (2006.01)
*H01H 3/08* (2006.01)

(58) Field of Classification Search
CPC ..... H01H 9/30; H01H 9/32; H01H 50/546; H01H 49/00; H01H 50/041; H01H 50/64
See application file for complete search history.

(56) References Cited

U.S. PATENT DOCUMENTS

| | | | | |
|---|---|---|---|---|
| 10,090,127 | B2 * | 10/2018 | Ito | H01H 50/56 |
| 11,574,784 | B2 * | 2/2023 | Yoo | H01H 51/065 |
| 2012/0092097 | A1 * | 4/2012 | Choi | H01H 1/2008 335/188 |
| 2015/0008105 | A1 * | 1/2015 | Haenel | H01H 1/20 200/243 |
| 2015/0077202 | A1 * | 3/2015 | Enomoto | H01H 1/54 335/171 |
| 2016/0104992 | A1 * | 4/2016 | Hammond | H01R 13/2478 439/32 |
| 2016/0233039 | A1 * | 8/2016 | Kanematsu | H01H 50/38 |
| 2018/0197710 | A1 * | 7/2018 | Yao | H01H 85/2045 |

FOREIGN PATENT DOCUMENTS

| | | | |
|---|---|---|---|
| CN | 108400061 | A | 8/2018 |
| CN | 109698098 | A | 4/2019 |
| CN | 110223883 | A | 9/2019 |

* cited by examiner

DRIVE STRUCTURE FOR HIGH-VOLTAGE DIRECT-CURRENT RELAY

BACKGROUND OF THE PRESENT INVENTION

Field of Invention

The present application relates to the field of high-voltage direct-current relay, and more specially relates to a drive structure for a high-voltage direct-current relay.

Description of Related Arts

At present, Chinese patent CN105551897B discloses a high-voltage direct-current relay and an assembly method therefor. The high-voltage direct-current relay comprises two fixed contacts and one movable assembly. The movable assembly comprises a movable spring part, a main spring and a pushing rod assembly. The pushing rod assembly consists of two independent components that are a pushing rod part and a U-shaped basket. The pushing rod part comprises a fixed piece and a pushing rod that are fixed together by insulation plastic. After the main spring, the movable spring part and the U-shaped basket are sequentially disposed at the top of the pushing rod part, the two ends of the fixed piece are respectively fixed with the bottom of the side part of the U-shaped basket, so that the main spring is elastically tightened between the bottom surface of the movable spring part and the insulation plastic of the pushing rod part, and a movable spring piece props against the inner side of the top of the U-shaped basket.

However, in the assembly process of the U-shaped basket, one side of the U-shaped basket must be clamped with one end of the fixed piece, and then the other side of the U-shaped basket must be clamped with the other end of the fixed piece. The movable spring piece and the main spring are accommodated in the space of the U-shaped basket. The assembly action is easy to make the movable spring piece and the main spring deviate and fall off, which leads to the assembly difficulty of the drive rod assembly. In addition, because the U-shaped basket is made of metal materials, when the reverse arc is generated, the U-shaped basket cannot extinguish the arc, which makes the relay easy to burn down and reduces the reverse electric life of the relay.

SUMMARY OF THE PRESENT INVENTION

Based on this, it is necessary to provide a drive structure for a high-voltage direct-current relay for the technical problems of difficult assembly and low reverse electrical life.

A drive structure for a high-voltage direct-current relay, comprising: a retaining frame, a stopper piece, a movable spring piece, and an elastic member. The two retaining side arms are disposed at two sides of the support plate, and the drive rod is connected to a bottom portion of the support plate. One end of the stopper piece is connected to a terminal end of one of the retaining side arms, the other end of the stopper piece is connected to a terminal end of the other retaining side arm. Both the elastic member and the movable spring piece are disposed between the two retaining side arms, one end of the elastic member presses against the support plate, the other end of the elastic member presses against the movable spring piece. A side of the movable spring piece facing away from the elastic member presses against the stopper piece. The stopper piece is provided with an arc isolation portion, the arc isolation portion is configured for isolating arcs.

In one embodiment, the elastic member is a compression spring.

In one embodiment, a side of the support plate facing the compression spring is provided with a limiting lug, and the limiting lug is inserted into an end of the compression spring adjacent to the support plate.

In one embodiment, a side of the movable spring piece facing the compression spring is provided with a limiting groove, and an end of the compression spring adjacent to the movable spring piece is inserted into the limiting groove.

In one embodiment, a terminal end of the retaining side arm is provided with first connecting holes, and one end of the stopper piece is inserted into one of the first connecting holes, and the other end of the stopper piece is inserted into another of the first connecting holes.

In one embodiment, two sides of the stopper piece are provides with a second connecting hole respectively, a terminal end of each retaining side arm is inserted into one second connecting hole, the two retaining side arms are riveted to the stopper piece respectively.

In one embodiment, the arc isolation portion is made of insulating varnish, and the insulating varnish is coated on a middle area of the stopper piece.

In one embodiment, the arc isolation portion is an insulating layer, and the insulating layer is wrapped on an outer surface of a middle area of the stopper piece.

In one embodiment, the stopper piece has a strip-shaped sheet structure, each retaining side arm is connected with a short side of the stopper piece, and a thickness of the stopper piece decreases uniformly from one short side to the other short side.

In one embodiment, the two retaining side arms, the support plate and the drive rod are integrally formed.

The drive structure for a high-voltage direct-current relay has an bottom-up assembly manner, in which the elastic member, the movable spring piece, and the stopper piece are stacked sequentially, and the stopper piece is connected to and retained by the two retaining side arms. The two retaining side arms also limit the elastic member in the assembly process to ensure that the elastic member do not tilt, thereby realizing a simple and fast assembly process, and increasing assembly efficiency of high-voltage direct-current relays. In addition, the arc isolation portion has an effect of isolating arcs, thereby improving a service life of high-voltage direct-current relays despite reverse arcs.

DETAILED DESCRIPTION OF THE PREFERRED EMBODIMENT

Figure 1:
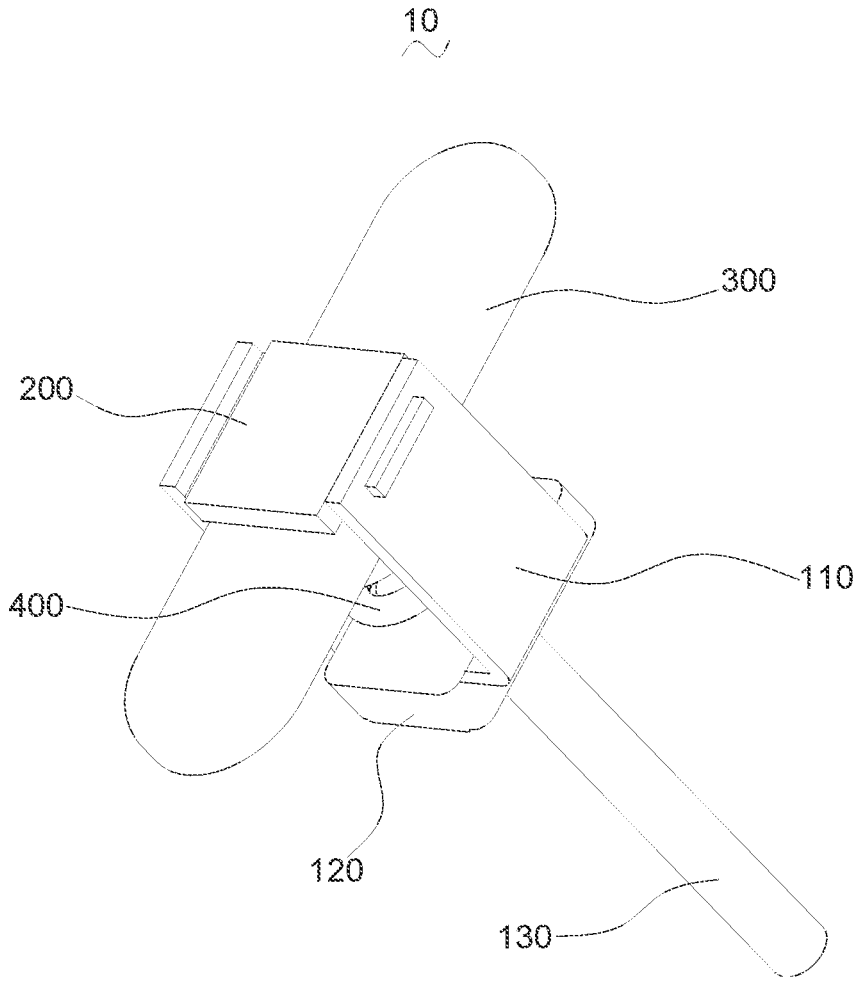
FIG. 1 is a structural diagram of the drive structure for a high-voltage direct-current relay in one embodiment.

In order to make the above purposes, features and advantages of the application more obvious and easy to understand, the specific implementation mode of the application is described in detail in combination with the attached drawings. Many specific details are described in the following description to facilitate a full understanding of the application.

However, the application can be implemented in many other ways different from those described here, and those skilled in the art can make similar improvements without violating the connotation of the application. Therefore, the application is not limited by the specific embodiments disclosed below.

In the description of the application, it needs to be understood that the orientation or position relationship indicated by the terms "center", "longitudinal", "transverse", "length", "width", "thickness", "up", "down", "front", "back", "left", "right", "vertical", "horizontal", "top", "bottom", "inside", "outside", "clockwise", "counterclockwise", "axial", "radial" and "circumferential" and so on is based on the orientation or position relationship shown in the figure, which is only for the convenience of describing the application and simplifying the description, rather than indicating or implying that the device or element must have a specific orientation and be constructed and operated in a specific orientation. Therefore, it cannot be understood as a limitation of the application.

In addition, the terms "first" and "second" are used for descriptive purposes only and cannot be understood as indicating or implying relative importance or implicitly indicating the number of technical features indicated. Thus, the features defined as "first" and "second" may explicitly or implicitly include at least one of the features. In the description of the application, "multiple" means at least two, such as two, three, etc., unless otherwise specified.

In the application, unless otherwise specified and limited, the terms "installing", "connection", "connected", "fixed" and other terms should be understood in a broad sense. For example, they can be fixedly connected, movably connected or integrally connected; they can be mechanically connected or electrically connected; they can be directly connected or indirectly connected through intermediate medium; they can be the internal connection of two components or the interaction between two components, unless otherwise specified. For those skilled in the art, the specific meaning of the above terms in the application can be understood according to the specific situation.

In the application, unless otherwise specified and limited, the first feature "up" or "down" of the second feature can be that the first and second features are in direct contact, or the first and second features are in indirect contact through an intermediate medium. Moreover, the first feature is "above", "on" and "at" the second feature, but the first feature is directly above or obliquely above the second feature, or only indicates that the horizontal height of the first feature is higher than that of the second feature. The first feature "below", "lower" and "under" of the second feature can be that the first feature is directly below or obliquely below the second feature, or only that the horizontal height of the first feature is less than that of the second feature.

It should be noted that when a component is said to be "fixed" or "arranged" to another component, it can be directly on another component or there can be a component in the middle. When a component is considered to be "connected" to another component, it can be directly connected to another component or there may be a component between them. The terms "vertical", "horizontal", "up", "down", "left", "right" and similar expressions used in this application are only for the purpose of illustration, and do not mean that they are the only mode of implementation.

Figure 2:
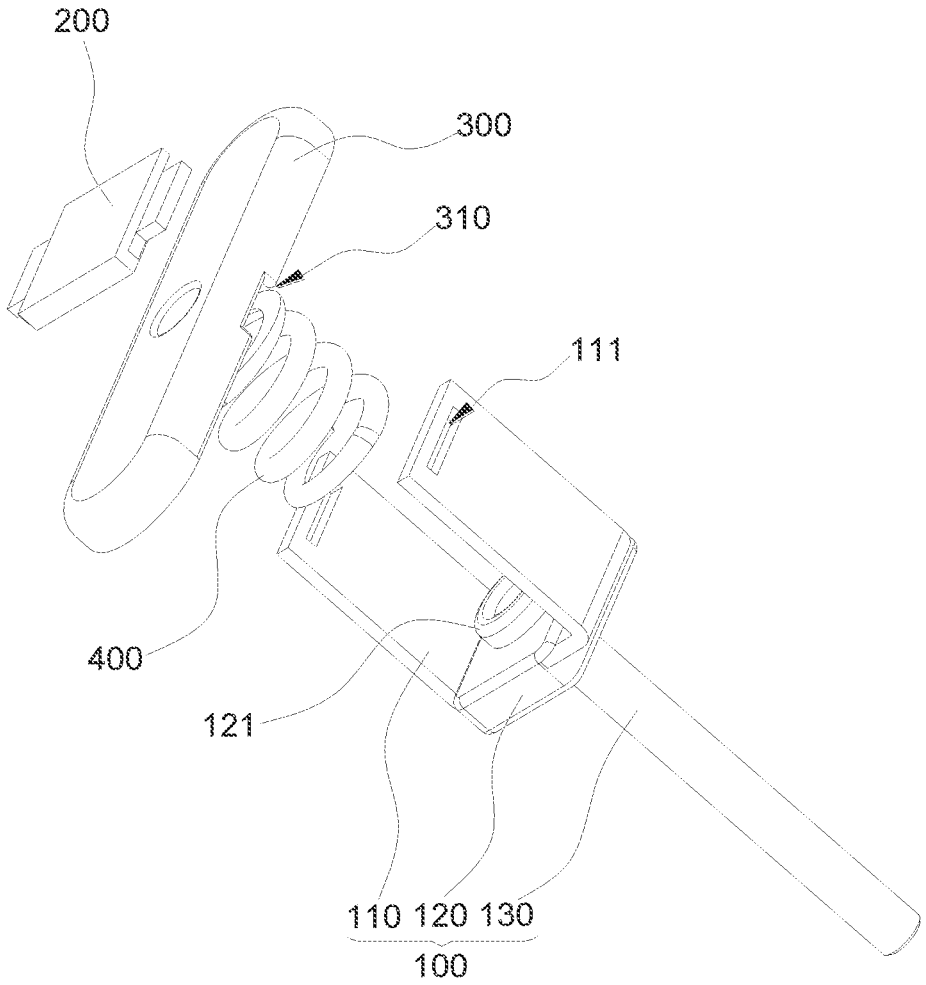
FIG. 2 is a structural diagram of disassembly structure of the drive structure for a high-voltage direct-current relay in one embodiment.
Figure 3:
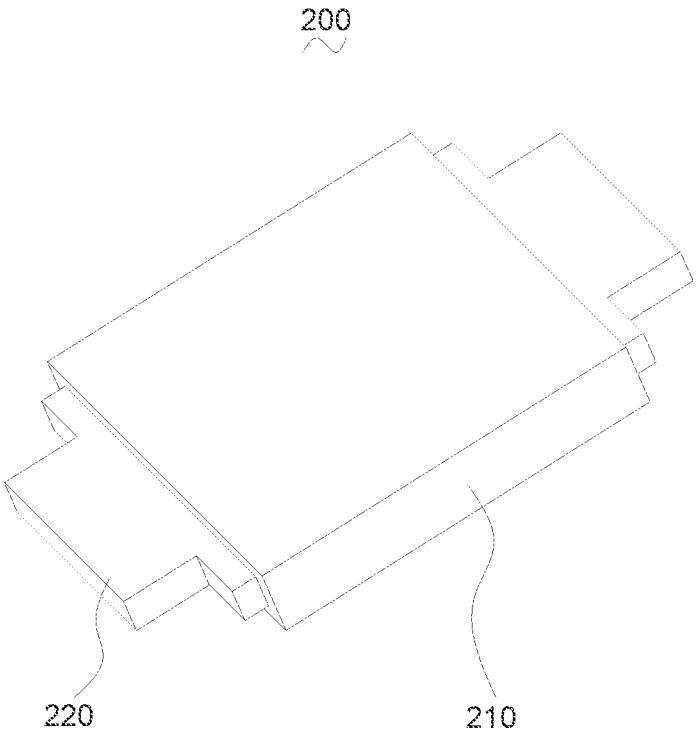
FIG. 3 is a structural diagram of the stopper piece of the drive structure for a high-voltage direct-current relay in one embodiment.
Figure 4:
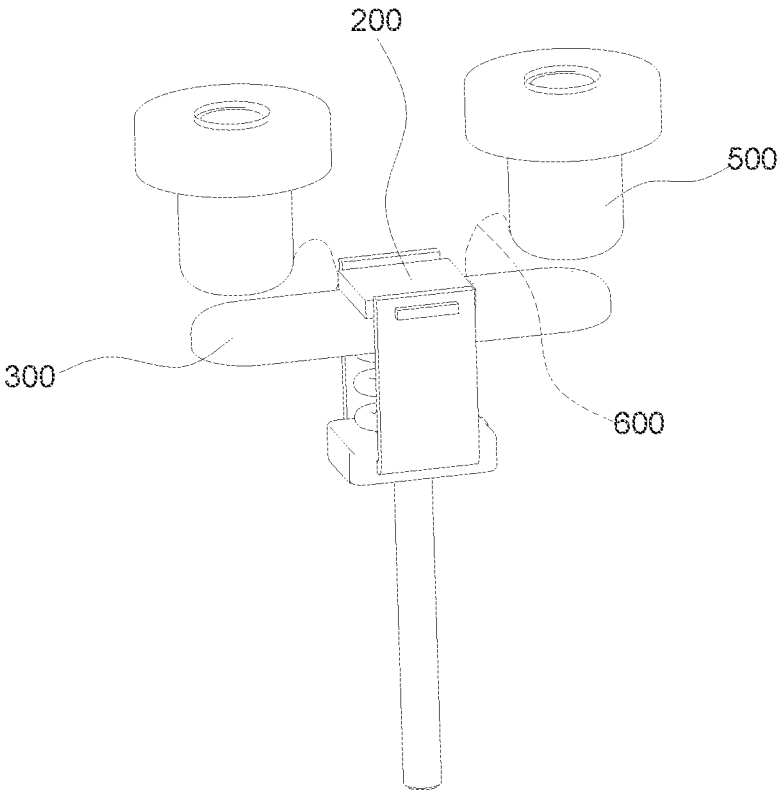
FIG. 4 is a structural diagram of the drive structure for a high-voltage direct-current relay in a working state.

Please referring to FIG. 1 to FIG. 3, the present application provides a drive structure 10 for a high-voltage direct-current relay, the drive structure 10 for a high-voltage direct-current relay 10 comprising: a retaining frame 100, a stopper piece 200, a movable spring piece 300 and an elastic member 400. The retaining frame 100 comprises two retaining side arms 110, a support plate 120 and a drive rod 130. The two retaining side arms 110 are disposed at two sides of the support plate 120, the drive rod 130 faces away from the retaining side arm 110 is connected to a bottom portion of the support plate 120. One end of the stopper piece 200 is connected to a terminal end of one of the retaining side arm 110, the other end of the stopper piece 200 is connected to a terminal end of the other retaining side arm 110. Both the elastic member 400 and the movable spring piece 300 are disposed between the two retaining side arms 110, one end of the elastic member 400 presses against the support plate 120, and the other end of the elastic member 400 presses against the movable spring piece 300. A side of the movable spring piece 300 facing away from the elastic member 400 presses against the stopper piece 200. The stopper piece 200 is provided with an arc isolation portion 210, and the arc isolation portion 210 is configured for isolating arcs.

The above drive structure 10 for a high-voltage direct-current relay has an bottom-up assembly manner, in which the elastic member 400, the movable spring piece 300, and the stopper piece 200 are stacked sequentially, and the stopper piece 200 is connected to and retained by the two retaining side arms 110. The two retaining side arms 110 also limit the elastic member 400 in the assembly process to ensure that the elastic member 400 do not tilt, thereby realizing a simple and fast assembly process, and increasing assembly efficiency of high-voltage direct-current relays. In addition, the arc isolation portion 210 has an effect of isolating arcs, thereby improving a service life of high-voltage direct-current relays despite reverse arcs.

Please referring to FIG. 1 to FIG. 4, the working principle of the drive structure for a high-voltage direct-current relay is as follows: when the coil in the high-voltage direct-current relay is energized, under the action of electromagnetic force, the retaining frame 100 drives the stopper piece 200, the movable spring piece 300 and the elastic member 400 to move towards the static contact 500 of the high-voltage direct-current relay, and the two ends of the movable spring piece 300 will respectively contact with the two static contacts 500 to conduct the circuit. At this time, the elastic member 400 is in the elastic compression state, and a certain gap is formed between the stopper piece 200 and the movable spring piece 300. Under the elastic force of the elastic member 400, the two ends of the movable spring piece 300 maintain the contact relationship with the two static contacts 500. When the coil is powered off, the retaining frame 100 drives the stopper piece 200, the movable spring piece 300 and the elastic member 400 to move away from the static contact 500. The two ends of the movable spring piece 300 are separated away from the two static contacts 500, thereby breaking the circuit. When the movable spring piece 300 is separated from the two static contacts 500, the elastic member 400 pushes the movable spring piece 300 to move towards the stopper piece 200 until the movable spring piece 300 presses against the stopper piece 200.

The assembly method of the drive structure for a high-voltage direct-current relay is as follows: first, put the elastic member 400 on the support plate 120 between the two retaining side arms 110. Then press the movable spring piece 300 against the terminal end of the elastic member 400 away from the support plate 120. At last, press the stopper piece 200 towards the movable spring piece 300, and connect the terminal ends of the two retaining side arm 110 with the two sides of the stopper piece 200 respectively, making the elastic member 400 and the movable spring piece 300 disposed between the support plate 120 and the stopper piece 200. The whole assembly process is from bottom to top, adopting the "stacking" method, which is convenient and quick to install.

The retaining frame 100 is configured for bearing the elastic member 400, the movable spring piece 300 and the stopper piece 200. In one embodiment, the retaining side arms 110 has a rectangular plate-shaped structure, the support plate 120 has a rectangular plate-shaped structure, and the drive rod 130 has a cylindrical structure. In this way, the structure of the retaining frame 100 composed of the two retaining side arms 110, the support plate 120 and the drive rod 130 is more stable and firm. Among them, the support plate 120 is configured for supporting the elastic member 400. The two retaining side arms 110 limit the elastic member 400 to prevent the elastic member 400 from tilting outwards for easy assembly. The drive rod 130 is a force bearing part, and the electromagnetic force acts on the drive rod 130 to promote the movement of the whole drive structure. In order to strengthen the connection relationship between the two retaining side arms 110, the support plate 120 and the drive rod 130, in one of the embodiments, the two retaining side arms 110, the support plate 120 and the drive rod 130 are integrally formed. In this way, the two retaining side arms 110, the support plate 120 and the drive rod 130 are firmly connected, and the retaining frame 100 has a certain impact resistance. During the assembly process, the two retaining side arms 110, the support plate 120 and the drive rod 130 are not easy to separate. In this way, the strength of the retaining frame 100 is improved, and the structural stability of the drive structure of the high-voltage direct-current relay is strengthened.

The elastic member 400 is used to provide an elastic force. When both ends of the movable spring piece 300 contact the two static contacts 500, the elastic force of the elastic member 400 acts on the movable spring piece 300 to maintain the contact relationship between the movable spring piece 300 and the static contact 500. In one of the embodiments, the elastic member 400 is a compression spring. A compression spring is a helical spring under axial pressure. The elastic strength of the compression spring is large, and the elastic force is high when the elastic deformation is restored. It ensures that the elastic member 400 can stably maintain the contact relationship between the movable spring piece 300 and the stopper piece 200. When the high-voltage direct-current relay acts and the movable spring piece 300 contacts the two static contacts 500, the elastic member 400 ensures a good contact relationship between the movable spring piece 300 and the two static contacts 500. In this way, the elastic potential energy of the elastic member 400 is improved, and the working stability of the drive structure of the high-voltage direct-current relay is improved.

The movable spring piece 300 is used for conducting the circuit. When the high-voltage direct-current relay is connected to the external circuit and the two static contacts 500 in the high-voltage direct-current relay contact the two ends of the movable spring piece 300, the external circuit is connected and the current flows through the movable spring piece 300.

The stopper piece 200 is used to further limit the elastic member 400 and the movable spring piece 300, so as to make the drive structure of the high-voltage direct-current relay stable and firm. One end of the stopper piece 200 is connected with the end of a retaining side arm 110, and the other end of the stopper piece 200 is connected with the end of another retaining side arm 110. In one embodiment, please referring to FIG. 2, the terminal end of the retaining side arm 110 is provided with a first connecting hole 111. One end of the stopper piece 200 is inserted into one first connecting hole 111, and the other end of the stopper piece 200 is inserted into another first connecting hole 111. That is, the stopper piece 200 and the two retaining side arms 110 are in a clamping relationship, so that the stopper piece 200 and the two retaining side arms 110 maintain a stable state. In this way, the connection stability between the stopper piece 200 and the two retaining side arms 110 is improved.

Furthermore, two ends of the stopper piece 200 are respectively provided with first connecting blocks 220, each of which is inserted into a first connecting hole 111 and connected with a retaining side arm 110. In this embodiment, the first connecting hole 111 is a rectangular hole, the first connecting block 220 has a cuboid structure, and the first connecting hole 111 is matched with the first connecting block 220. In another embodiment, the first connecting hole 111 is a circular hole, the first connecting block 220 has a cylindrical structure, and the first connecting hole 111 is matched with the first connecting block 220. In this way, each first connecting block 220 is inserted into a first connecting hole 111 to clamp the stopper piece 200 with the two retaining side arms 110. In this way, the clamping relationship between the stopper piece 200 and the two retaining side arms 110 is realized, and the connection strength between the stopper piece 200 and the two retaining side arms 110 is improved.

Figure 5:
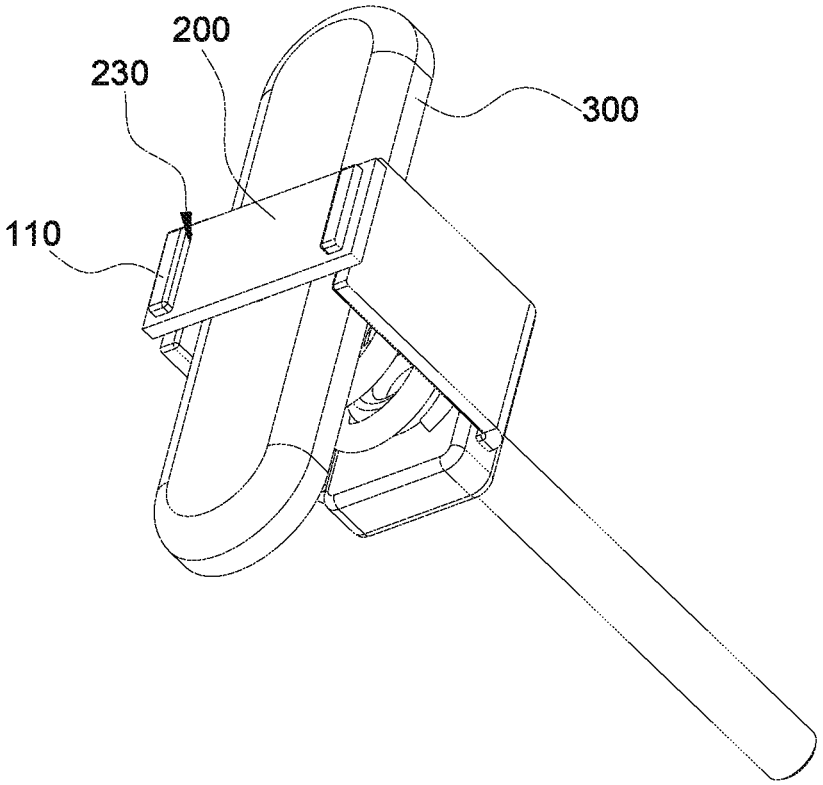
FIG. 5 is another structural diagram of the high-voltage direct-current relay in one embodiment.

Please refer to FIG. 5, in one of the embodiments, a second connecting hole 230 is respectively set on both sides of the stopper piece 200, the end of each retaining side arm 110 is inserted into a second connecting hole 230, and the two retaining side arms 110 are respectively connected with the stopper piece 200. In this embodiment, the second connecting hole 230 is a rectangular hole, the end of the retaining side arm 110 has a cuboid structure, and the second connecting hole 230 is matched with the end of the retaining side arm 110. In another embodiment, the second connecting hole 230 is a circular hole, the end of the retaining side arm 110 has a cylinder structure, and the second connecting hole 230 is matched with the end of the retaining side arm 110. When the ends of the two retaining side arms 110 are inserted with the stopper piece 200, the connection relationship between the two retaining side arms 110 and the stopper piece 200 is further stabilized by the bonding method. In another embodiment, the two retaining side arms 110 are respectively welded with the stopper piece 200. In this way, the stopper piece 200 is not easy to be separated from the two retaining side arms 110, further strengthening the connection relationship between the two retaining side arms 110 and the stopper piece 200.

Figure 6:
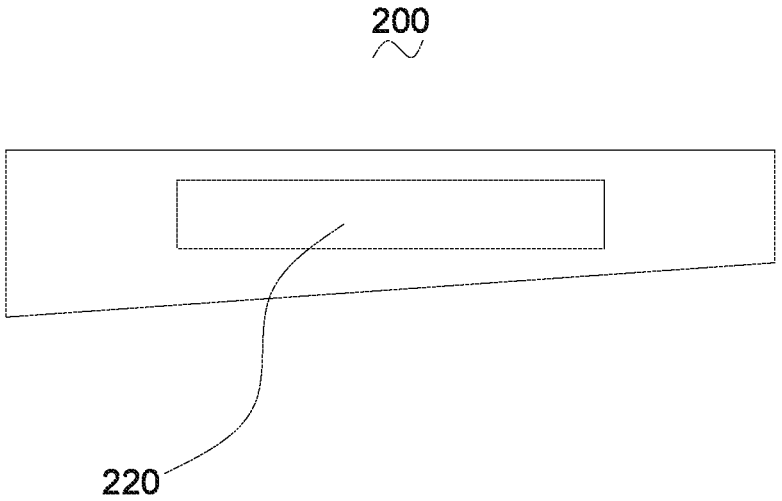
FIG. 6 is another structural diagram of the stopper piece of the drive structure for a high-voltage direct-current relay in one embodiment.
Figure 7:
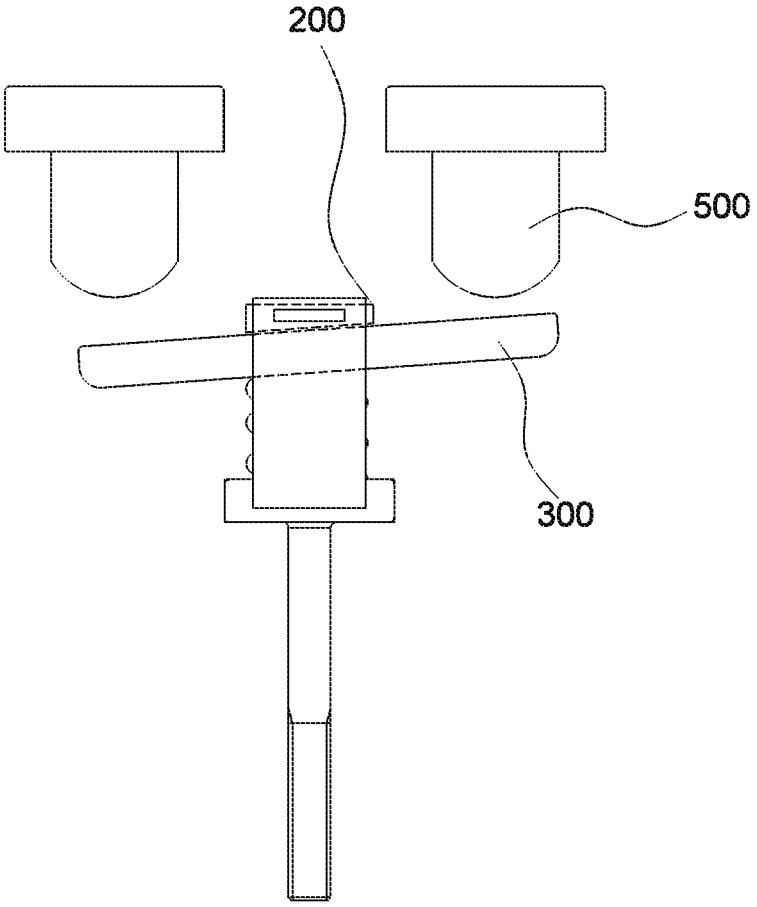
FIG. 7 is a structural diagram of the high-voltage direct-current relay in another working state.

In order to improve the adhesive resistance of the movable spring piece 300, in one of the embodiments, please refer to FIG. 6 and FIG. 7, the stopper piece 200 has a strip-shaped sheet structure, each retaining side arm 110 is connected with the short side of the stopper piece 200, and the thickness of the stopper piece 200 decreases evenly from the long side of one side to the long side of the other side. That is to say, the thickness of the stopper piece 200 is different, and the side of the stopper piece 200 facing the movable spring piece 300 is an inclined plane. When the movable spring piece 300 presses against the stopper piece 200, the movable spring piece 300 will tilt. When the high-voltage direct-current relay acts, the coil is energized, the movable spring piece 300 moves towards the two static contacts, and the two ends of the movable spring piece 300 contact the two static contacts in turn. When the coil loses power, the movable spring piece 300 moves away from the two static contacts, and the two ends of the movable spring piece 300 are separated from the two static contacts in turn. In the technical field of relay, the static contact is usually arranged in a hemispherical structure. When the movable spring piece 300 moves towards the two static contacts, the two static contacts press against the two ends of the movable spring piece 300 in turn, and the movable spring piece 300 will change from inclined to horizontal. When the two static contacts are in contact with the movable spring piece 300, the contact point between the static contact and the movable spring piece 300 will roll along the hemispherical arc surface of the static contact, so as to effectively avoid bonding. In this way, the adhesive resistance of the movable spring piece 300 is enhanced, and the durability of the movable spring piece 300 is improved.

Figure 8:
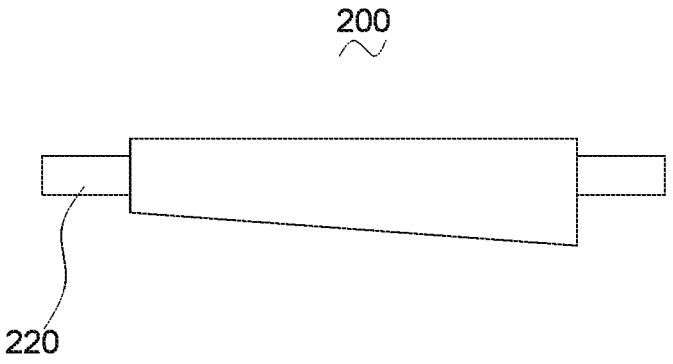
FIG. 8 is another structural diagram of the stopper piece of the drive structure for a high-voltage direct-current relay in one embodiment.
Figure 9:
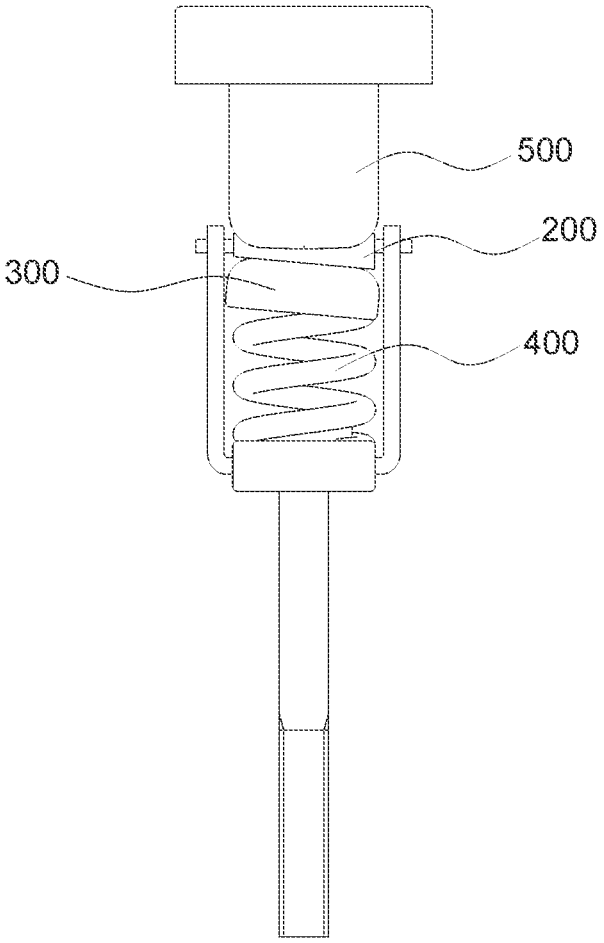
FIG. 9 is a structural diagram of the high-voltage direct-current relay in another working state.

Further, please refer to FIG. 8 and FIG. 9 together, in one of the embodiments, the stopper piece 200 has a strip-shaped sheet structure, each retaining side arm 110 is connected with one short side of the stopper piece 200, and the thickness of the stopper piece 200 decreases evenly from one short side to the other short side. That is to say, the thickness of the stopper piece 200 is different, and the side of the stopper piece 200 facing the movable spring piece 300 is an inclined plane. When the movable spring piece 300 butts with the stopper piece 200, the movable spring piece 300 will tilt. In the process of the contact between the two static contacts and the movable spring piece 300, the movable spring piece 300 gradually changes from an inclined state to a horizontal state, and the contact point between the static contact and the movable spring piece 300 will roll along the hemispherical arc surface of the static contact, so as to effectively avoid bonding. In this way, the adhesive resistance of the movable spring piece 300 is enhanced.

The arc isolation portion 210 is used for isolating the arc. When the movable spring piece 300 is about to contact with the two static contacts, an arc will be generated between the two static contacts and the movable spring piece 300. Please refer to FIG. 4, especially for the reverse arc 600, if the arc is short circuited through stopper piece 200, the stopper piece 200 will be easily burned, and even the whole high-voltage direct-current relay will be damaged. In one of the embodiments, the arc isolation portion 210 is made of insulating varnish, and the insulating varnish is applied to the middle area of the stopper piece 200. In this embodiment, the insulating varnish is polytetrafluoroethylene, which has excellent insulation performance and plays an effective role in isolating reverse arc 600. Polytetrafluoroethylene also has excellent properties such as high temperature resistance, wear resistance and corrosion resistance, so as to enhance the durability of arc isolation portion 210, which can isolate reverse arc 600 for a long time. In this way, the working stability of the arc isolation portion 210 is enhanced, and the reverse electric life of the drive structure for a high-voltage direct-current relay is improved.

In one of the embodiments, the arc isolation portion 210 is an insulating layer, and the insulating layer is wrapped on the outer surface of the middle area of the stopper piece 200. In this embodiment, the insulating layer is a polyvinyl chloride layer. In another embodiment, the insulating layer is a polyethylene layer. PVC and PE are excellent insulating materials. In addition, they also have the characteristics of chemical stability, cold resistance, fire resistance, aging resistance and corrosion resistance. The setting of the insulation layer has an insulating effect on the reverse arc, and the arc cannot be short circuited through the stopper piece 200. In this way, the reverse arc short circuit is avoided, and the reverse electric life of the drive structure for a high-voltage direct-current relay is further improved.

Referring to FIG. 2, in order to limit the contact position between the compression spring and the support plate 120, in one of the embodiments, the support plate 120 is provided with a limiting lug 121 on the side facing the compression spring, and the limiting lug 121 is inserted at the end of the compression spring adjacent to the support plate 120. In this embodiment, the limiting lug 121 is a cylinder lug. The limiting lug 121 is inserted into the end of the compression spring to limit the contact position between the compression spring and the support plate 120, so that the compression spring is not easy to shake and tilt with the support plate 120, and it is difficult to separate and eject from the support plate 120 during the assembly process of the drive structure for a high-voltage direct-current relay. In this way, it is convenient for users to complete the assembly of the elastic member 400, and improves the assembly efficiency of the drive structure for a high-voltage direct-current relay.

In order to limit the contact position between the compression spring and the movable spring piece 300, in one of the embodiments, please refer to FIG. 2, the movable spring piece 300 is provided with a limit groove 310 on the side facing the compression spring, and the end of the compression spring adjacent to the movable spring piece 300 is inserted in the limiting groove 310. In this embodiment, the limiting groove 310 is a circular groove. The limiting groove 310 is matched with the end of the elastic member 400. The end of the compression spring adjacent to the movable spring piece 300 is inserted in the limiting groove 310 to limit the contact position of the compression spring and the movable spring piece 300. The compression spring is not easy to move in the transverse direction, so that the contact relationship between the compression spring and the movable spring piece 300 is more stable, and the user is easy to complete the assembly operation of the movable spring piece 300 and the elastic member 400. In this way, it is convenient for the user to complete the assembly of the moving spring piece 300, and further improves the assembly efficiency of the drive structure for a high-voltage direct-current relay.

Furthermore, in one of the embodiments, a limiting boss (not shown in the figure) is arranged on the side of the movable spring piece 300 facing the compression spring, and the limiting boss is inserted at the end of the compression spring adjacent to the movable spring piece 300. In this embodiment, the limiting boss is a cylinder structure. The limiting boss is matched with the end of the elastic member 400 adjacent to the movable spring piece 300. The limiting boss is inserted at the end of the compression spring adjacent to the movable spring piece 300 to limit the contact position between the compression spring and the movable spring piece 300. The compression spring is not easy to move in the transverse direction, so that the contact relationship between the compression spring and the movable spring piece 300 is more stable, and the user is easy to complete the assembly of the movable spring piece 300 and the elastic member 400. In this way, it is convenient for the user to complete the assembly of the movable spring piece 300, and further improves the assembly efficiency of the drive structure for a high-voltage direct-current relay.

The technical features of the above-mentioned embodiments can be arbitrarily combined. In order to make the description concise, all possible combinations of the technical features in the above-mentioned embodiments are not described. However, as long as there is no contradiction in the combination of these technical features, it should be considered as the scope of the description.

The above-mentioned embodiments only express several embodiments of the application, and the description is more specific and detailed, but it can not be understood as a limitation on the scope of the application. It should be pointed out that for ordinary technicians in the art, a number of modifications and improvements can be made without departing from the concept of the application, all these belong to the protection scope of the application. Therefore, the protection scope of the application shall be subject to the attached claims.

What is claimed is:

1. A drive structure for a high-voltage direct-current relay, wherein, comprising: a retaining frame, a stopper piece, a movable spring piece, and an elastic member;

the retaining frame comprises two retaining side arms, a support plate and a drive rod; the two retaining side arms are disposed at two sides of the support plate, and the drive rod faces away from the retaining side arms and is connected to a bottom portion of the support plate;

one end of the stopper piece is connected to a terminal end of one of the retaining side arms, the other end of the stopper piece is connected to a terminal end of the other retaining side arm; both the elastic member and the movable spring piece are disposed between the two retaining side arms, one end of the elastic member presses against the support plate, the other end of the elastic member presses against the movable spring piece; a side of the movable spring piece facing away from the elastic member presses against the stopper piece; the stopper piece is provided with an arc isolation portion, the arc isolation portion is configured for isolating arcs;

wherein, the stopper piece has a strip-shaped sheet structure, each retaining side arm is connected with a short side of the stopper piece, and a thickness of the stopper piece decreases uniformly from one short side to the other short side.

2. The drive structure for a high-voltage direct-current relay according to claim 1, wherein, the elastic member is a compression spring.

3. The drive structure for a high-voltage direct-current relay according to claim 2, wherein, a side of the support plate facing the compression spring is provided with a limiting lug, and the limiting lug is inserted into an end of the compression spring adjacent to the support plate.

4. The drive structure for a high-voltage direct-current relay according to claim 3, wherein, a side of the movable spring piece facing the compression spring is provided with a limiting groove, and an end of the compression spring adjacent to the movable spring piece is inserted into the limiting groove.

5. The drive structure for a high-voltage direct-current relay according to claim 1, wherein, a terminal end of each of the retaining side arms is provided with a first connecting hole, and one end of the stopper piece is inserted into the first connecting hole of one of the retaining side arms, and the other end of the stopper piece is inserted into the first connecting hole of another of the retaining side arms.

6. The drive structure for a high-voltage direct-current relay according to claim 1, wherein, two sides of the stopper piece are provides with a second connecting hole respectively, a terminal end of each retaining side arm is inserted into one second connecting hole, the two retaining side arms are riveted to the stopper piece respectively.

7. The drive structure for a high-voltage direct-current relay according to claim 1, wherein, the arc isolation portion is made of insulating varnish, and the insulating varnish is coated on a middle area of the stopper piece.

8. The drive structure for a high-voltage direct-current relay according to claim 1, wherein, the arc isolation portion is an insulating layer, and the insulating layer is wrapped on an outer surface of a middle area of the stopper piece.

9. The drive structure for a high-voltage direct-current relay according to claim 1, wherein, the two retaining side arms, the support plate and the drive rod are integrally formed.

* * * * *